US009062872B2

(12) United States Patent
Liang et al.

(10) Patent No.: US 9,062,872 B2
(45) Date of Patent: Jun. 23, 2015

(54) ELECTRONIC DEVICE WITH ILLUMINATING ASSEMBLY

(71) Applicant: Zhongshan Innocloud Intellectual Property Services Co., Ltd., Zhongshan (CN)

(72) Inventors: Wei-Kuang Liang, New Taipei (TW); Quan-Guang Du, Shenzhen (CN); Qiang-Wu Dai, Shenzhen (CN)

(73) Assignee: Zhongshan Innocloud Intellectual Property Services Co., Ltd., Zhongshan (CN)

( * ) Notice: Subject to any disclaimer, the term of this patent is extended or adjusted under 35 U.S.C. 154(b) by 103 days.

(21) Appl. No.: 13/948,111

(22) Filed: Jul. 22, 2013

(65) Prior Publication Data

US 2014/0140039 A1 May 22, 2014

(30) Foreign Application Priority Data

Nov. 22, 2012 (CN) ..... 2012 1 04772914

(51) Int. Cl.

| | |
|---|---|
| ***F21V 19/02*** | (2006.01) |
| ***F21V 21/14*** | (2006.01) |
| *F21V 21/26* | (2006.01) |
| *F21V 21/30* | (2006.01) |
| *F21Y 101/00* | (2006.01) |
| *F21V 17/02* | (2006.01) |

(52) U.S. Cl.

CPC ..... *F21V 21/14* (2013.01); *F21V 21/26* (2013.01); *F21V 21/30* (2013.01); *F21V 19/02* (2013.01); *F21Y 2101/00* (2013.01); *F21V 17/02* (2013.01)

(58) Field of Classification Search

CPC . F21Y 2101/00; F21Y 2010/02; F21V 21/30; F21V 21/26; F21V 21/14; F21V 17/02; F21V 19/02; F21V 21/18

USPC ..... 362/177, 217.16, 249.03, 249.1, 269, 362/282, 283, 285, 287, 372, 85, 271

See application file for complete search history.

(56) References Cited

U.S. PATENT DOCUMENTS

| | | | | | |
|---|---|---|---|---|---|
| 2,421,680 | A * | 6/1947 | Candlin, Jr. et al. | ..... | 362/483 |
| 4,399,498 | A * | 8/1983 | Bacevius | ..... | 362/396 |
| 4,600,978 | A * | 7/1986 | Kimura | ..... | 362/365 |
| 4,893,221 | A * | 1/1990 | Friedman | ..... | 362/108 |
| 6,142,644 | A * | 11/2000 | Leung | ..... | 362/98 |
| 2009/0080204 | A1 * | 3/2009 | Puglisi | ..... | 362/371 |

* cited by examiner

*Primary Examiner* — Andrew Coughlin
*Assistant Examiner* — Glenn Zimmerman
(74) *Attorney, Agent, or Firm* — Novak Druce Connolly Bove + Quigg LLP

(57) ABSTRACT

An illuminating assembly includes a bracket, an engaging member, a light module, and a biasing member. The bracket includes a frame and a pressing panel rotatably located on the frame. The engaging member is attached to the bracket. The engaging member includes a first engaging portion which can be disengaged to release the light module. The light module is pivotally coupled to the bracket and is biased inwards when unreleased, and biased outwards and illuminated when released. The light module includes a base, a light source located on the base, and second engaging portion. The light module is movable from a closed position to an open position, to illuminate a keyboard.

18 Claims, 10 Drawing Sheets

ELECTRONIC DEVICE WITH ILLUMINATING ASSEMBLY

BACKGROUND

The disclosure generally relates to illuminating assemblies, in particular to an illuminating device assembled on an electronic device.

DESCRIPTION OF RELATED ART

Electronic devices, such as laptop or notebook computers, are oftentimes utilized in dark environments, thereby making it difficult to view or utilize the device's working surface (e.g., the keyboard or touch pad). Lighting systems have been devised to facilitate use of electronic devices in dark environments. However, such systems do not adequately direct light to the desired location. There is a room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
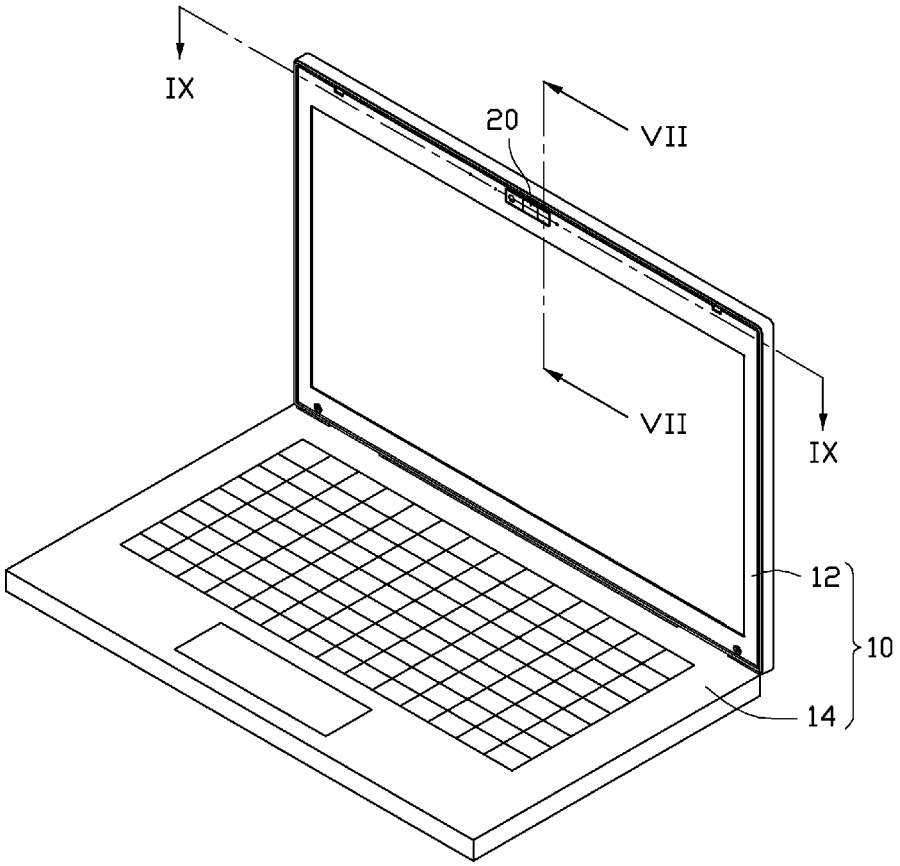
FIG. 1 is an assembly view of an electronic device in one embodiment.

FIG. 1 is one embodiment of an electronic device 10. The electronic device includes a top cover 12 and a bottom cover 14. The top cover 12 is rotatable relative to the bottom cover 14. The electronic device 10 may be a laptop computer, or a portable computer or the like.

Figure 2:
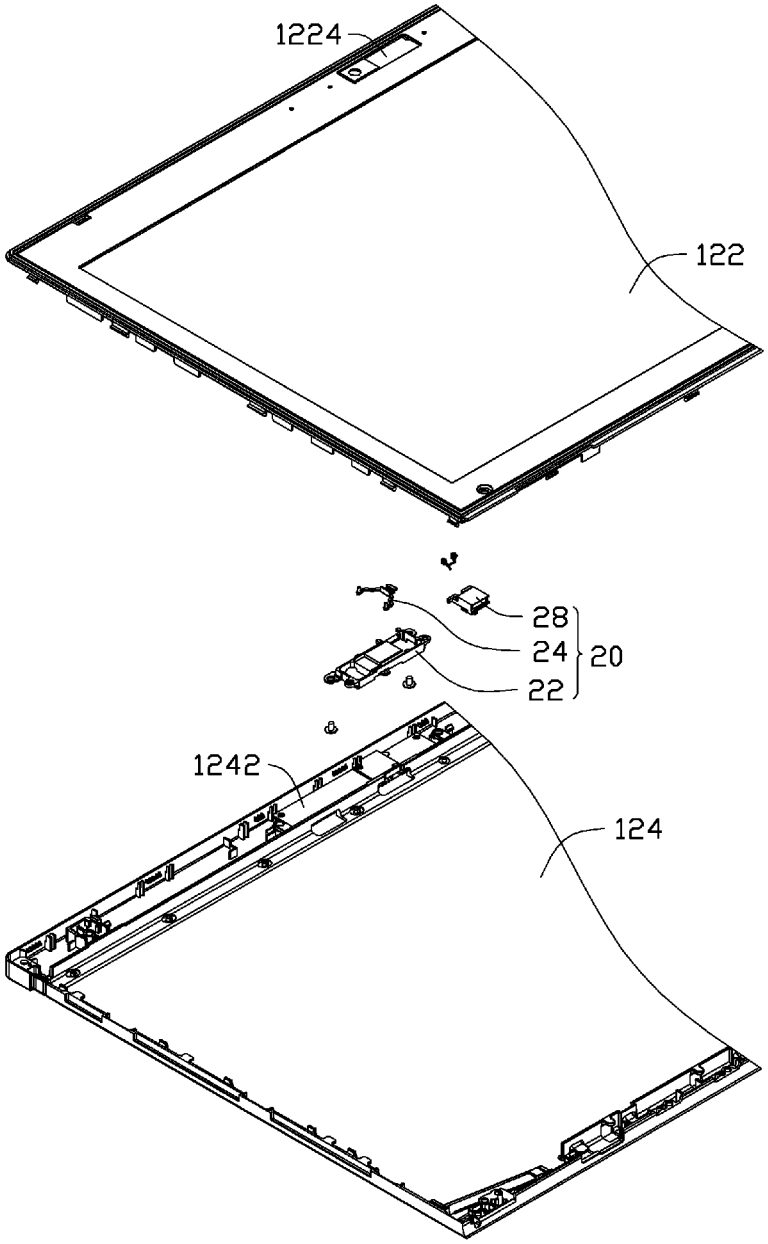
FIG. 2 is a partially exploded, isometric view of an illuminating assembly and a top cover of the electronic device of FIG. 1.
Figure 3:
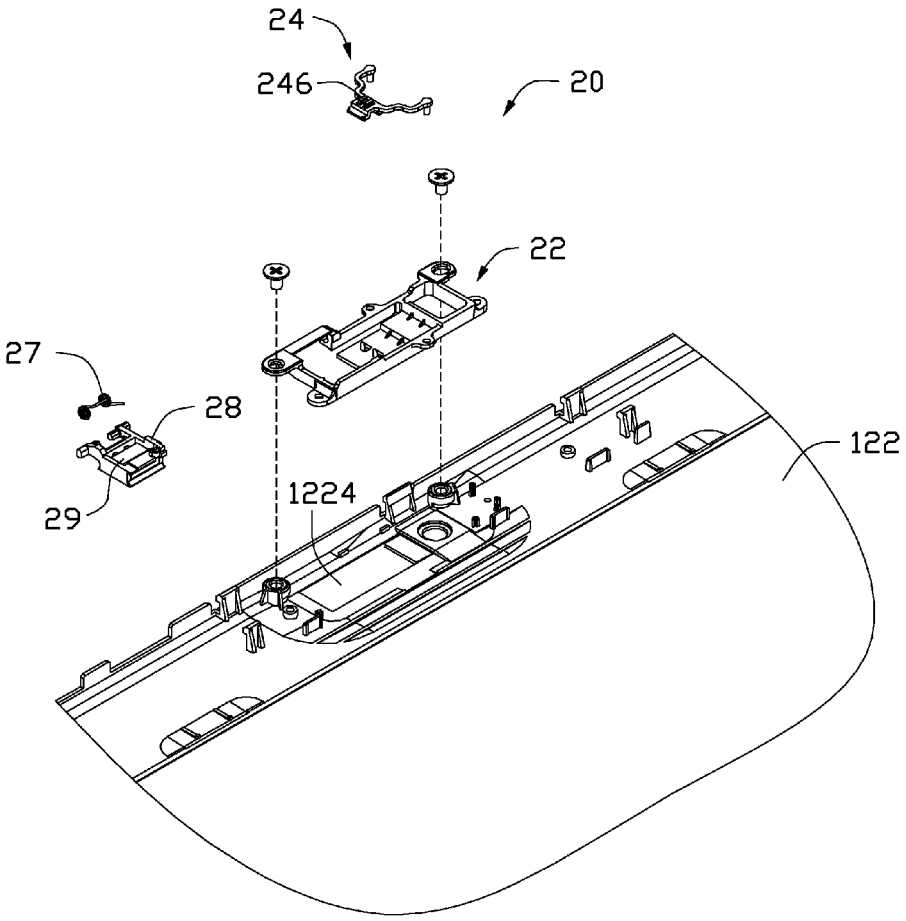
FIG. 3 is a partial view of a front panel of the top cover and the illuminating assembly of FIG. 2
Figure 4:
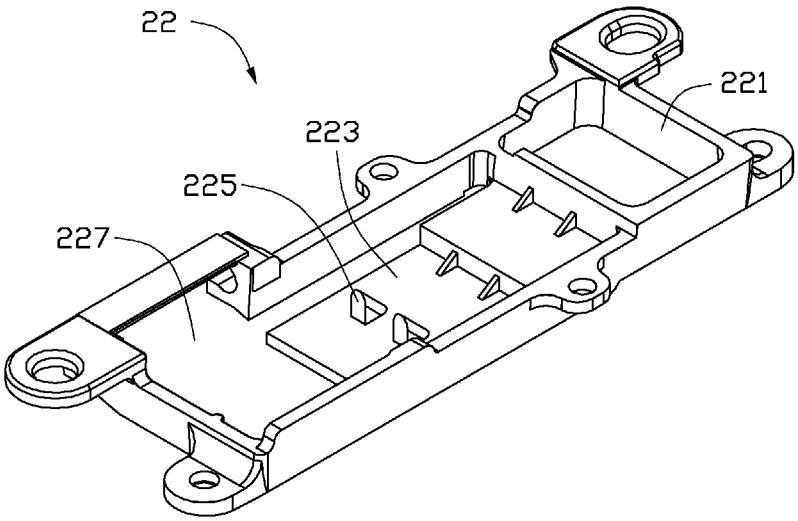
FIG. 4 is an isometric view of a bracket of the illuminating assembly of FIG. 3.
Figure 7:
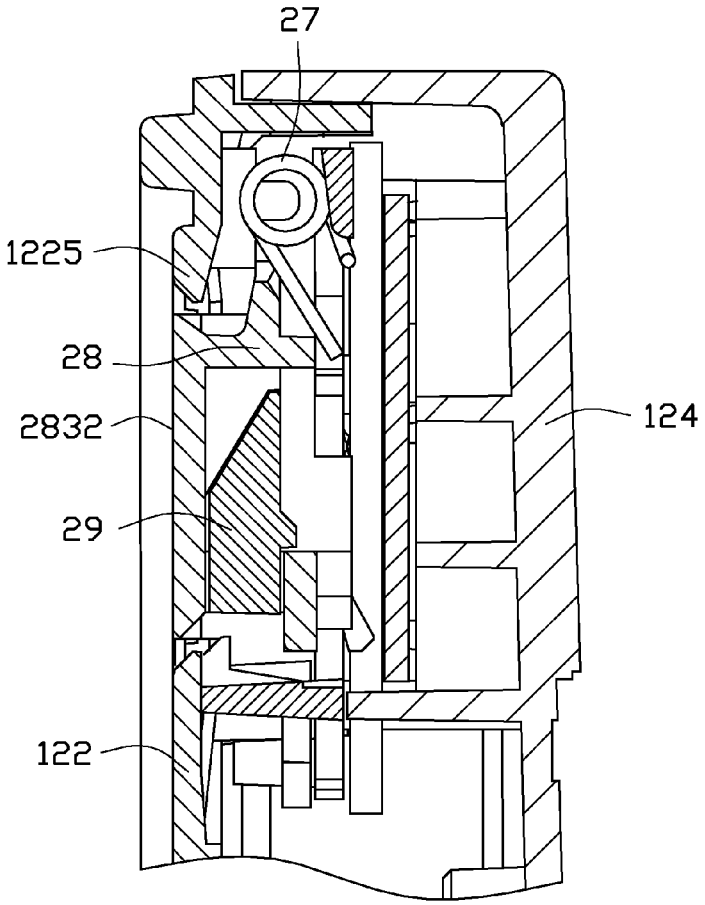
FIG. 7 is a partial cross sectional view of the light module and the top cover along a line VII-VII of FIG. 1.
Figure 8:
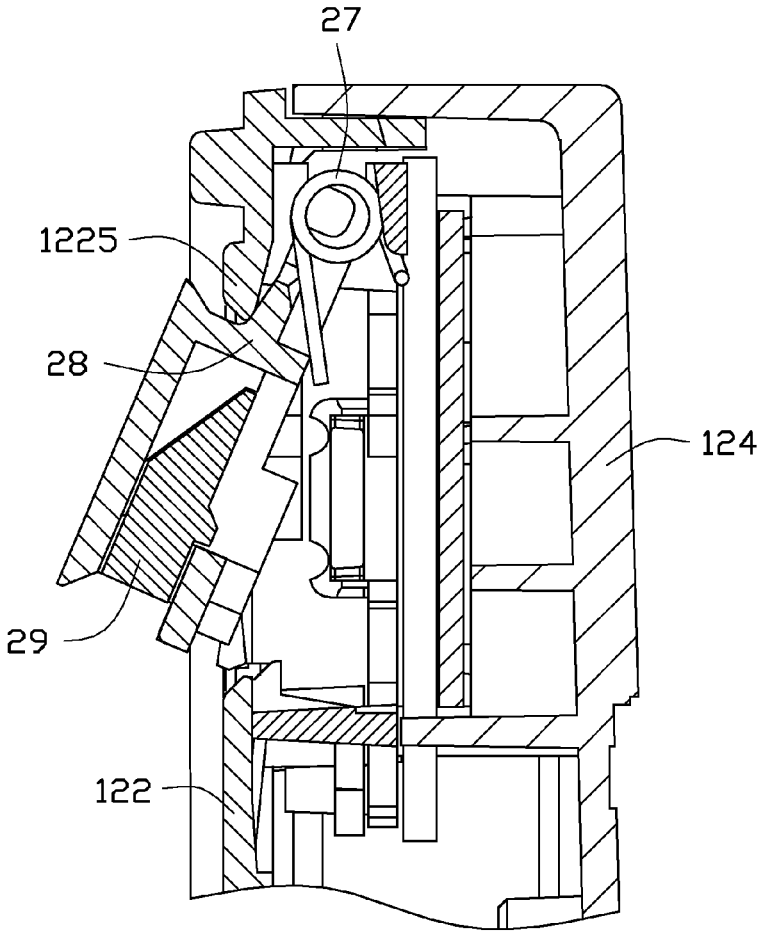
FIG. 8 is similar to FIG. 7, but the light module is in an open position.
Figure 9:
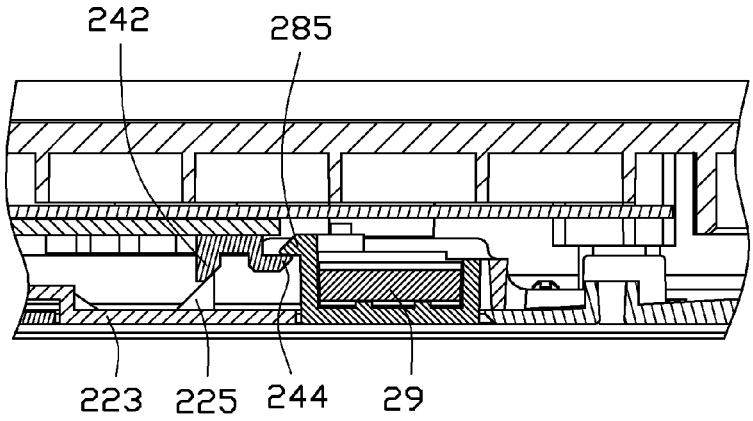
FIG. 9 is a partial cross sectional view of the light module and the top cover along a line IX-IX of FIG. 1.
Figure 10:
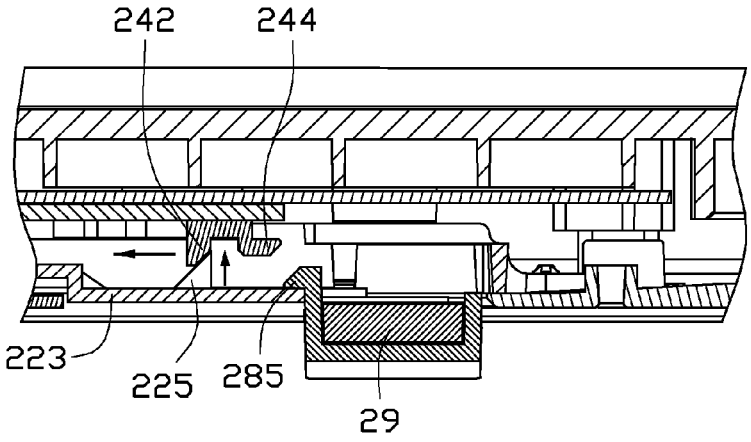
FIG. 10 is similar to FIG. 9, but the light module is in the open position.

FIG. 2 and FIG. 3 illustrate two exploded partial views of the top cover 12 and an illuminating assembly 20. The top cover 12 includes a front panel 122 and a rear panel 124. An opening 1224 is defined in the front panel 122. A block 1225 is located in the front panel 122 (shown in FIG. 7). A mounting board 1242 is located inside the rear panel 124.

The illuminating assembly 20 is located on the top cover 12. The illuminating assembly 20 includes a bracket 22, an engaging member 24, and a light module 28.

FIG. 3 illustrates an isometric view of the bracket 22. The bracket 22 includes a frame 221 and a pressing panel 223 rotatably located on the frame 221. The pressing panel 223 is integral with the frame 221. A receiving space 227 is defined in the frame 221 adjacent to a free distal end of the pressing panel 223. Two first urging portions 225 protrude from an inner side of the pressing panel 223. The two first urging portions 225 are wedge-shaped.

Figure 5:
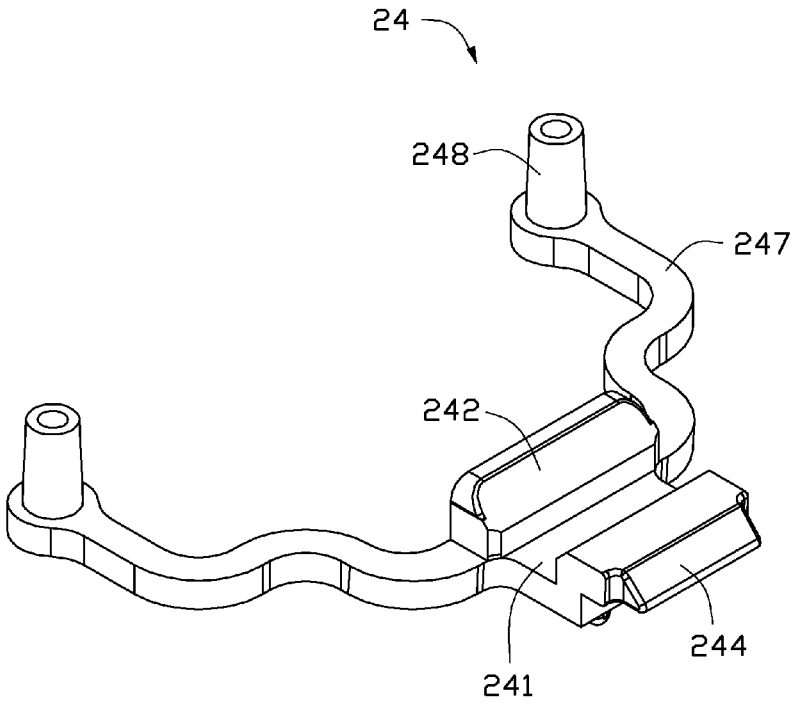
FIG. 5 is an isometric view of an engaging member of the illuminating assembly of FIG. 3.

FIG. 5 illustrates an isometric view of the engaging member 24. The engaging member 24 includes a body 241, two resilient arms 247 extending from the body 241, a second urging portion 242 located on the body 241, a first engaging portion 244 located on the body 241, and two posts 248 located on the two resilient arms 247. Two parallel ridges 246 are located on the body 241 opposite to the second urging portion 242. Each of the two resilient arms 247 is substantially S-shaped. A first extending direction of the first engaging portion 244 is substantially perpendicular to a second extending direction of the first engaging portion 244.

Figure 6:
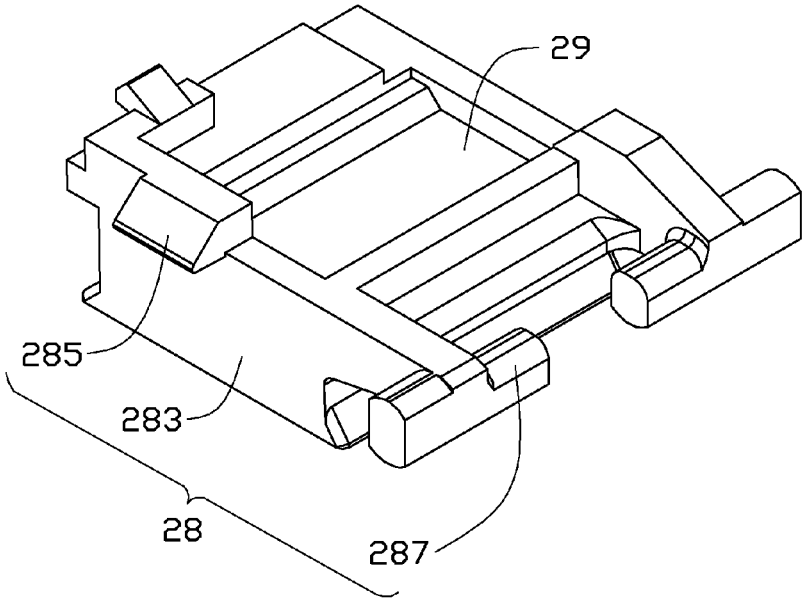
FIG. 6 is an isometric view of a light module of the illuminating assembly of FIG. 3.

FIG. 6 illustrates an isometric view of the light module 28. The light module 28 includes a base 283, two pivot portions 287, a second engaging portion 285 and a light source 29 located in the base 283. The base 283 defines an outer surface 2832 (shown in FIG. 7). A biasing member 27 is attached to the light module 28 to bias the light module 28 from the bracket 22. The biasing member 27 can be a coil spring.

FIGS. 7 to 10 illustrate four assembled partial and sectional views of illuminating assembly 20 and the top cover 12. In assembly, the light module 28 is pivotably attached to the bracket 22 in the receiving space 227. The two posts 248 are mounted to the bracket 22. The first urging portion 225 abuts against the second urging portion 242. The light module 28 is received in the bracket 22, and the first engaging portion 244 of the engaging member 24 locks the second engaging portion 285 of the light module 28. The illuminating assembly 20 is mounted to the top cover 12. The pressing panel 223 is accessible through the opening 1224.

When using the light source 29, the light module 28 is moved from a closed position to an open position. The pressing panel 223 is pressed from an inner side of the top cover 12. The first urging portion 225 urges the second urging portion 242 to laterally move the engaging member 24. The two resilient arms 247 are compressed and move away from the light module 28. A first moving direction of the first urging portion 225 is substantially perpendicular to a second moving direction of the second urging portion 242. The first engaging portion 244 is disengaged from the second engaging portion 285. The light module 28 is thus released. The biasing member 27 biases the light module 28 to stably stand out from the top cover 12. The light source 29 of the light module 28 illuminates the bottom cover 14 and a keyboard on the bottom cover 14.

It is to be understood, however, that even though numerous characteristics and advantages have been set forth in the foregoing description of embodiments, together with details of the structures and functions of the embodiments, the disclosure is illustrative only and changes may be made in detail, especially in the matters of shape, size, and arrangement of parts within the principles of the disclosure to the full extent indicated by the broad general meaning of the terms in which the appended claims are expressed.

What is claimed is:

1. An illuminating assembly, comprising:

a bracket comprising a frame and a pressing panel rotatably located on the frame;

an engaging member attached to the bracket, and the engaging member comprises a first engaging portion;

a light module pivotally coupled to the bracket; and the light module comprising a base, a light source located on the base, and second engaging portion; and a biasing member;

wherein the light module is movable from a close position to an open position; in the close position, the first engaging portion engages with the second engaging portion to lock the light module; in the open position, the pressing panel is pressed in to laterally move the engaging member to disengage the first engaging portion from the second engaging portion, and the light module is rotated from the bracket by the biasing member.

2. The illuminating assembly of claim 1, wherein the pressing panel comprises a first urging portion, the engaging member further comprises a second urging portion to engage with first urging portion, and the each of the first urging portion and the second urging portion is wedge-shaped.

3. The illuminating assembly of claim 2, wherein a first moving direction of the first urging portion is substantially perpendicular to a second moving direction of the second urging portion when the light module is moved from the close position to the open position.

4. The illuminating assembly of claim 2, wherein the engaging member comprising at least one resilient arm, and the at least one resilient arm is compressed when the engaging member is laterally moved by the pressing panel.

5. The illuminating assembly of claim 4, wherein the at least one resilient arm comprises two resilient arms, and each of the two resilient arms is substantially S-shaped.

6. The illuminating assembly of claim 1, wherein the pressing panel is integral with the frame.

7. The illuminating assembly of claim 1, wherein each of the first engaging portion and the second engaging portion is wedge-shaped.

8. The illuminating assembly of claim 1, wherein the biasing member is a coil spring.

9. An electronic device, comprising:

an enclosure, comprising a top cover and a bottom cover, and the top cover rotatable relative to the bottom cover; and an illuminating assembly mounted on the top cover, the electronic device comprising:

a bracket comprising a frame and a pressing panel rotatably located on the frame;

an engaging member attached to the bracket, and the engaging member comprises a first engaging portion;

a light module pivotally coupled to the bracket, and the light module comprising a base, a light source located on the base, and second engaging portion; and a biasing member;

wherein the light module is movable from a close position to a open position; in the close position, the first engaging portion engages with the second engaging portion to lock the light module; in the open position, the pressing panel is pressed in to laterally move the engaging member to disengage the first engaging portion from the second engaging portion, and the light module is rotated from the bracket by the biasing member.

10. The electronic device of claim 9, wherein the pressing panel comprises a first urging portion, the engaging member further comprises a second urging portion to engage with first urging portion, and the each of the first urging portion and the second urging portion is wedge-shaped.

11. The electronic device of claim 10, wherein a first moving direction of the first urging portion is substantially perpendicular to a second moving direction of the second urging portion when the light module is moved from the close position to the open position.

12. The electronic device of claim 10, wherein the engaging member comprising at least one resilient arm, and the at least one resilient arm is compressed when the engaging member is laterally moved by the pressing panel.

13. The electronic device of claim 12, wherein the at least one resilient arm comprises two resilient arms, and each of the two resilient arms is substantially S-shaped.

14. The electronic device of claim 9, wherein the pressing panel is integral with the frame.

15. The electronic device of claim 9, wherein each of the first engaging portion and the second engaging portion is wedge-shaped.

16. The electronic device of claim 9, wherein the biasing member is a coil spring.

17. The electronic device of claim 9, wherein the light module resides in the top cover in the close position, and protrudes from the top cover in the open position.

18. The electronic device of claim 9, wherein the pressing panel is accessible from the top cover.

* * * * *